United States Patent [19]

Kojima et al.

[11] Patent Number: 4,477,501

[45] Date of Patent: Oct. 16, 1984

[54] WELDED CAN AND PROCESS FOR PREPARATION THEREOF

[75] Inventors: Shunji Kojima; Tadahiko Katsura, both of Yokohama; Hiroshi Ueno, Yokosuka; Kazuo Taira, Tokyo; Tsuneo Imatani, Yokosuka, all of Japan

[73] Assignee: Toyo Seikan Kaisha, Ltd., Tokyo, Japan

[21] Appl. No.: 443,213

[22] Filed: Nov. 19, 1982

Related U.S. Application Data

[63] Continuation of Ser. No. 225,994, Jun. 19, 1981.

[30] Foreign Application Priority Data

Jan. 18, 1980 [JP] Japan ..... 55-3502

[51] Int. Cl.[3] ..... B65D 65/40

[52] U.S. Cl. ..... 428/35; 428/344; 428/349; 156/320; 156/272.6; 220/80; 220/457; 220/468; 228/150

[58] Field of Search ..... 156/321, 320, 272.6; 220/80, 457, 468, DIG. 29; 228/149, 150, 151; 428/35, 344, 349, 463

[56] References Cited

U.S. PATENT DOCUMENTS

| | | | |
|---|---|---|---|
| 2,797,843 | 7/1957 | Orlins | 220/457 |
| 2,994,454 | 8/1961 | Crowe | 220/480 |
| 3,077,171 | 2/1963 | Gotsch et al. | 228/150 |
| 3,661,696 | 5/1972 | Knutson | 428/463 |
| 3,682,767 | 8/1972 | Britton et al. | 428/349 |
| 3,905,854 | 9/1975 | Kaercher et al. | 156/321 |
| 4,115,617 | 9/1978 | Mitsuishi et al. | 428/344 |

*Primary Examiner*—John E. Kittle

*Attorney, Agent, or Firm*—Sherman & Shalloway

[57] ABSTRACT

Disclosed is a coated welded can having a metal-exposed face inclusive of a seam covered with a coating, wherein the coating comprises at least one organic resin coating layer and at least one metal film, and at least the portion of the organic resin coating that adheres to the metal-exposed face is comprised of a copolymer of ethylene with a carbonyl group-containing, ethylenically unsaturated monomer or a blend containing this copolymer.

In this coated welded can, the adhesion of the coating, the corrosion resistance of the seam and the appearance characteristics of the seam are highly improved. Furthermore, the coating of this welded can is not damaged by such processing as flanging, beading or double-seaming or when the welded can is subjected to the retort sterilization.

16 Claims, 2 Drawing Figures

WELDED CAN AND PROCESS FOR PREPARATION THEREOF

This is a continuation of application Ser. No. 225,994, filed June 19, 1981.

BACKGROUND OF THE INVENTION (1) Field of the Invention

The present invention relates to a welded can having a novel laminate coating on the metal-exposed face of a seam and a process for the preparation thereof. More particularly, the present invention relates to a welded can excellent in the corrosion resistance, the appearance of the seam and the content-retaining property and a process for the preparation thereof.

(2) Description of the Prior Art

Since the bonded portion of a welded can is formed by welding metals at a high temperature under an elevated pressure, in case of a tinplate can, for example, a tin layer is isolated and the iron face becomes exposed to the outside. Furthermore, in case of a welded can of a steel sheet electrolytically treated with chromic acid (often called "TFS"), a chromium or chromium oxide layer of the portion to be bonded is removed by mechanical scraping before welding and the iron face is similarly exposed. Moreover, at a cut edge of a metal blank for a can, iron is exposed to the outside, and this cut edge is present on each of both the sides of the seam of the welded can. Since welding is carried out under high compression in the state where both the edges of a metal blank for a can are lapped together, molten iron spreads to the step portion of the seam to form an iron-exposed portion. When a canned food or the like is packed in such welded can, iron is dissolved out into the packed content from the iron-exposed portion, causing various fatal disadvantages. For example, the flavor of the packed content is degraded by iron dissolved out, and a pinhole can or hydrogen swollen can is formed by corrosion of the iron-exposed portion, with the result that the content-preserving property is reduced.

In addition to the above-mentioned problem of formation of an iron-exposed portion on the seam, the welded can involves a problem of reduction of the appearance characteristics such as blackening or browning of the appearance due to oxidation of iron in the seam portion (it is believed that triiron tetroxide is formed) and rusting of the iron-exposed face caused while an empty can or packed can is stored.

As means for overcoming these defects, a trial has been made to protect a metal-exposed face inclusive of a seam in a welded can with an organic resin coating formed by applying a varnish or the like. However, this trial is still insufficient for satisfactorily attaining the object of completely preventing iron from being dissolved out from the seam and preventing occurrence of corrosion of the seam. More specifically, a known organic resin coating material is poor in the adhesion to the metal-exposed face and even if a good adhesion to the metal-exposed face is obtained, the corrosion-preventive effect is insufficient or the processability of the coated portion is not good. For example, most of thermosetting resin varnishes fail to completely cover cut edges of seams, and coatings of these varnishes are poor in the processability and cracks or other defects are readily formed at the flanging process or seaming process. A coating composed of a tape of a thermoplastic resin is insufficient in the barrier property to corrosive components and no sufficient anti-corrosive effect can be obtained, and when the coated can is subjected to retort sterilization, the adhesion of the coating is drastically reduced.

As pointed out above, it is very difficult to form a coating excellent in the adhesion and corrosion resistance on a metal-exposed face inclusive of a seam in a welded can. In addition to this problem, a welded can involves the following problem. In the preparation of a welded can, the surface of a blank, except the edges to be formed into a seam, is preliminarily coated or printed with an organic resin varnish or ink, the coated or printed blank is cut into a predetermined size if necessary, the edges are lapped together and the blank is formed into a cylinder, and the lapped portion is welded to form a can body. Accordingly, an organic resin coating applied to the seam should have a good adhesion not only to the metal-exposed face but also to an edge portion of the coated or printed surface. Very few coatings show a good adhesion to both the metal-exposed face and the coated or printed surface, and none of organic resin coatings have a substantial adhesion to a coating or printing ink layer in which a lubricant has been incorporated so as to improve the running characteristic of the can-manufacturing blank or improve the scratch resistance of the coating or printing ink layer.

SUMMARY OF THE INVENTION

We found that when a laminate coating comprising an organic resin coating layer and a metal film is used as the coating covering a metal-exposed face inclusive of a seam in a welded can and a copolymer of ethylene with a carbonyl group-containing, ethylenically unsaturated monomer or a blend thereof is used for the organic resin coating layer to be applied to the metal-exposed surface, all of the above-mentioned defects can effectively be eliminated and a coated welded can excellent in the corrosion resistance of the seam, the appearance characteristics and the adhesion of the coating can be obtained. We have now completed the present invention based on this finding.

It is therefore a primary object of the present invention to provide a coated welded can having a metal-exposed face covered with a laminate coating comprising a metal film and a specific resin coating, which is excellent in the adhesion of the coating, the corrosion resistance of the seam and the appearance characteristics.

Another object of the present invention is to provide a coated welded can having a coating having an excellent adhesion to not only the metal-exposed face inclusive of the seam but also the coated or printed faces located on both the sides of the seam, in which the corrosion resistance can highly be improved.

Still another object of the present invention relates to a process for the preparation of a coated welded can body in which the above-mentioned metal-resin laminate coating can easily and promptly be formed on the seam portion.

In accordance with the present invention, there is provided a coated welded can having a metal-exposed face inclusive of a seam covered with a coating, wherein said coating comprises at least one organic resin coating layer and at least one metal film, and at least the portion of the organic resin coating that adheres to the metal-exposed face is comprised of a copolymer of ethylene with a carbonyl group-containing, ethylenically unsaturated monomer or a blend containing said copolymer.

The present invention will now be described in detail.

DETAILED DESCRIPTION OF THE PREFERRED EMBODIMENTS

The welded can of the present invention may be formed of an optional metal blank, for example, an untreated steel plate (black plate), an electrically plated or melt-plated steel plate such as a tin-plated steel plate (tinplate), a zinc-plated steel plate or a chromium-plated steel plate, a steel plate chemically or electrolytically treated with phosphoric acid and/or chromic acid, especially a steel plate electrolytically treated with chromic acid (TFS plate), and a sheet or plate of a light metal such as aluminum.

Figure 1:
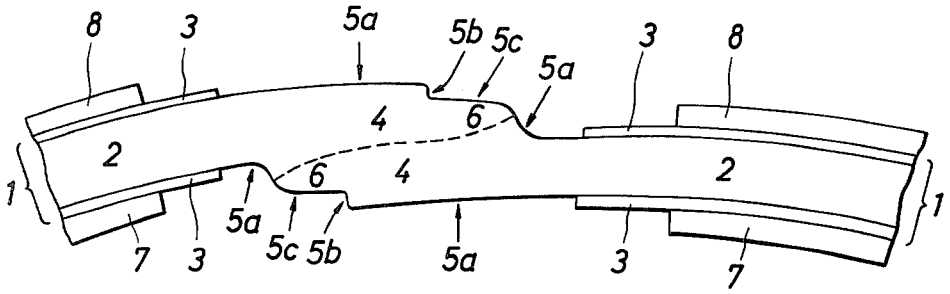
FIG. 1 is a view showing the sectional structure of the seam portion in a welded can according to the present invention.

Referring to FIG. 1 illustrating an example of the sectional structure of the seam portion in a welded can according to the present invention, a can blank 1 comprises, for example, a steel plate substrate 2 and a chromium-containing coating layer 3 formed on the substrate 2. This can blank 1 is formed into a cylinder by lapping both the edges 4 of the can blank 1, and the lapped edges are welded together in the state where the chromium-containing layer 3 is removed from the lapped edges, whereby a seam is formed. In this seam, there are present an iron-exposed face 5*a* formed by removal of the chromium-containing coating layer from the lapped portion, an iron-exposed face 5*b* of a cut edge and an iron-exposed face 5*c* formed by bulging of molten iron to the step portion 6.

The blank 1 is coated or printed except both the edges 4 to be bonded. For example, a protective coating 7 is formed on the inner face of a welded can and a printing ink 8 is formed on the outer face.

It is one of important characteristic features of the present invention that the metal-exposed face inclusive of the seam should be covered with a laminate coating comprising at least one organic resin coating layer and at least one metal film and the resin coating layer adhering to the metal-exposed face should be comprised of a copolymer of ethylene with a carbonyl group-containing, ethylenically unsaturated monomer or a blend containing said copolymer.

Figure 2:
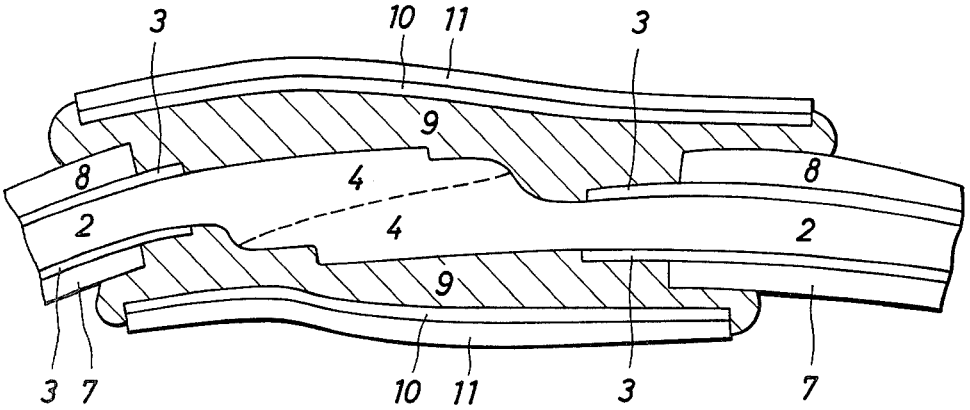
FIG. 2 is a view showing a preferred embodiment of the sectional structure of the seam portion in a welded can according to the present invention.

Referring to FIG. 2 illustrating a preferred embodiment of the coated welded can according to the present invention, a layer a comprised of a copolymer of ethylene with a carbonyl group-containing, ethylenically unsaturated monomer (often called "ethylene/carbonyl-containing ethylenic monomer copolymer" hereinafter) or a blend containing said copolymer adheres closely to the metal-exposed face inclusive of a seam 4, and a metal film 10 is formed on the copolymer layer 9, and it is especially preferred that a heat-resistant protective resin layer 11 be formed on the metal film 10.

These laminate coatings 9, 10 and 11 have a good adhesion to not only the metal-exposed face of the seam but also the edges of the coating face 7 or printed face 8 located on both the sides of the seam, whereby the welding seam is completely covered and protected.

The ethylene/carbonyl-containing ethylenic monomer copolymer used in the present invention has a good compatibility with all the welding seam having a complicated configuration including the above-mentioned iron-exposed faces 5*a*, 5*b* and 5*c* and the corners of the step portion 6 at the hot bonding process and adheres completely to these portions to cover these portions completely. Furthermore, this copolymer is characteristic and distinguishable over other thermoplastic resins in the point where even if the coated structure is subjected to processing such as flanging, beading or double seaming, cracking or peeling is not caused at all. Furthermore, by coating the metal-exposed portion with the ethylene/carbonyl-containing ethylenic monomer copolymer and forming the metal film 10 on this copolymer layer, permeation of corrosive components such as oxygen and ions to the metal-exposed face is completely inhibited and a very excellent anti-corrosive effect can be obtained. Furthermore, the metal-exposed face 5*a* colored into black or brown by formation of triiron tetroxide is completely covered up by the metal film 10, and the appearance of the seam is highly improved.

The ethylene/carbonyl-containing ethylenic monomer copolymer has a good adhesion to not only the metal-exposed face but also the coated or printed face, and this good adhesion is not damaged even if a lubricant is incorporated in the coating or printing ink layer or in the copolymer layer per se. This is one of prominent advantages attained by the present invention.

In the present invention, as the ethylene/carbonyl-containing ethylenic monomer copolymer, there is used a copolymer of ethylene with an ethylenically unsaturated monomer containing a carbonyl group $$(-\underset{\underset{O}{\|}}{C}-)$$

derived from a carboxylic acid, a carboxylic anhydride, a carboxylic acid ester, a carboxylic acid amide or imide, an aldehyde or a ketone.

As preferred examples of the carbonyl group-containing, ethylenically unsaturated monomer to be used in the present invention, the following compounds can be mentioned, though the monomers that can be used in the present invention are not limited to those exemplified below.

(A) Ethylenically unsaturated carboxylic acids such as acrylic acid, methacrylic acid, maleic acid, fumaric acid, crotonic acid, itaconic acid, citraconic acid and 5-norbornene-2,3-dicarboxylic acid.

(B) Ethylenically unsaturated carboxylic anhydrides such as maleic anhydride, citraconic anhydride, 5-norbornene-2,3-dicarboxylic anhydride and tetrahydrophthalic anhydride.

(C) Ethylenically unsaturated esters such as ethyl acrylate, methyl methacrylate, 2-ethylhexyl acrylate, monoethyl maleate, diethyl maleate, vinyl acetate, vinyl propionate, propyl $\gamma$-hydroxymethacrylate, ethyl $\beta$-hydroxyacrylate, glycidyl acrylate and glycidyl methacrylate.

(D) Ethylenically unsaturated amides and imides such as acrylamide, methacrylamide and maleimide.

(E) Ethylenically unsaturated aldehydes and ketones such acrolein, methacrolein, vinylmethyl ketone and vinylbutyl ketone.

It is preferred that the carbonyl group-containing, ethylenically unsaturated monomer be incorporated in an amount of 0.5 to 40% by weight, especially 3 to 25% by weight, in the copolymer. If the amount of this monomer is too small and below the lower limit, the resulting coating sometimes fails to have a satisfactory adhesion or processability. If the amount of the carbonyl group-containing, ethylenically unsaturated monomer is too large and beyond the upper limit, the mechanical strength of the coating resin layer is reduced and the flavor-retaining property is often degraded. The carbonyl group-containing, ethylenically unsaturated monomer may be included in the main chain or side chain of the polymer in the form of a so-called random, block or graft copolymer. Such copolymer may be prepared by optional known means.

As the copolymer that is easily obtainable and is suitable for attaining the objects of the present invention, there can be mentioned, in order of importance rank, an ethylene/vinyl acetate copolymer and an ethylene/acrylic acid copolymer.

The molecular weight of the ethylene/carbonyl-containing ethylenic monomer copolymer that is used in the present invention is not particularly critical, so far as the copolymer has a film-forming property, and from the viewpoints of the mechanical properties and processability, it is preferred to use a copolymer having a melt index of 0.1 to 60 g/10 min.

The ethylene/carbonyl-containing ethylenic monomer copolymer may be used singly or in the form of a blend with other resin, rubber or wax. As the preferred blend, there can be mentioned a composition comprising 70 to 98% by weight of a copolymer of ethylene with a carbonyl group-containing, ethylenically unsaturated monomer and 2 to 30% by weight of a tackifier. As the tackifier, there may be used known tackifiers, for example, vinyl aromatic hydrocarbon polymers such as polystyrene and polyvinyl toluene, terpene polymers, and rosins such as rosin, polymerized rosin, hydrogenated rosin and rosin modified with maleic acid, a phenolic resin or an epoxy resin.

The above-mentioned ethylene/carbonyl-containing ethylenic monomer copolymer or its blend may comprise, incorporated therein, 0.05 to 5% by weight, especially 0.1 to 10% by weight, based on the copolymer, of a lubricant or parting agent for preventing blocking when the copolymer or blend is used in the form of a multi-layer tape described hereinafter.

Preferred examples of the lubricant that can be used in the present invention include the following compounds, though lubricants that may be used in the present invention are not limited to those exemplified below.

(1) Aliphatic hydrocarbons such as fluid paraffin, white mineral oil of the industrial grade, synthetic paraffin, petroleum wax, petrolatum and odorless light hydrocarbon.

(2) Silicones such as organopolysiloxanes.

(3) Fatty acids, aliphatic alcohols and higher fatty acids, such as fatty acids derived from animal and vegetable oils and fats and having 8 to 22 carbon atoms and hydrogenation products of these fatty acids, linear aliphatic monohydric alcohols having at least 4 carbon atoms, which are obtained by reduction of animal and vegetable oils and acids or fatty acid esters thereof or by decomposition and distillation of natural waxes, and tridecyl alcohol.

(4) Polyglycols such as polyethylene glycol having a molecular weight of 200 to 9,500, polypropylene glycol having a molecular weight of at least 1,000, and polyoxypropylene/polyoxyethylene block copolymers having a molecular weight of 1,900 to 9,000.

(5) Amides and amines such as higher fatty acid amides, oleylpalmitamide, stearylerucamide, 2-stearoamidoethyl stearate, ethylene-bis-fatty acid amides, N,N'-oleoylstearylethylene-diamine, N,N'-bis(2-hydroxyethyl)alkyl($C_{12}$–$C_{18}$)amides, N,N'-bis(hydroxyethyl)lauroamide, oleic acid reacted with N-alkyl($C_{16}$–$C_{18}$)-trimethylene-diamine, fatty acid diethanolamines and a distearic acid ester of di(hydroxyethyl)-diethylene-triamine monoacetate.

(6) Fatty acid esters of monohydric and polyhydric alcohols such as n-butyl stearate, hydrogenated rosin methyl ester, di-n-butyl sebacare, dioctyl sebacate (2-ethylhexyl and n-octyl sebacates), glycerin fatty acid esters, glyceryl lactostearyl, pentaerythritol stearate, pentaerythritol tetrastearate, sorbitan fatty acid esters, polyethylene glycol monostearate, polyethylene glycol dilaurate, polyethylene glycol monooleate, polyethylene glycol dioleate, polyethylene glycol coconut oil fatty acid ester, polyethylene glycol tall oil fatty acid esters, ethane-diol montanate, 1,3-butane-diol montanate, diethylene glycol stearate and propylene glycol fatty acid esters.

(7) Triglycerides, waxes, hydrogenated edible oils and fats, cotton seed oil, other edible oils, linseed oil, palm oil, glycerin 1,2-hydroxystearate, hydrogenated fish oils, beef tallow, sperm acetiwax, montan wax, carnauba, wax, bees wax, haze wax, monohydric aliphatic alcohol-aliphatic saturated acid esters such as hardened sperm oil lauryl stearate and stearyl stearate, and hydrous lanolin.

(8) Alkali metal, alkaline earth metal, zinc and aluminum salts of higher fatty acids (metal soaps).

(9) Low-molecular-weight olefin resins such as low-molecular-weight polyethylene, low-molecular-weight polypropylene and oxidized polyethylene.

(10) Fluorine resins such as polytetrafluoroethylene, tetrafluoroethylene/hexafluoropropylene copolymers, polychlorotrifluoroethylene and polyvinyl fluoride.

(11) Other lubricants such as propylene glycol alginate, dialkyl ketones and acrylic copolymers (such as Moda-Flow supplied by Monsanto).

The metal film that is used in the present invention may be a metal foil or a metal film formed on a resin film by nonelectrode plating, electrolytic plating, vacuum deposition, sputtering or ion plating. As the metal foil, there can be mentioned, for example, an aluminum foil, a tin foil, a steel foil, a surface-treated steel foil and a stainless steel foil. An aluminum foil is especially preferred because it is easily available. The metal film formed on the film substrate by vacuum deposition or the like may be comprised of aluminum, tin, chromium, nickel, cobalt, copper, zinc or titanium.

The laminate coating layer that is used in the present invention may have an optional layer structure, so far as a layer of the ethylene/carbonyl-containing ethylenic monomer copolymer or its blend is located on the metal-exposed face side and a metal film such as mentioned above is located on this copolymer layer. However, in order to prevent breakage of the metal film at the can-manufacturing process, at the time of handling or during the use and obtain a durable corrosion resistance, it is preferred that a resin coating be present on each of both the sides of the metal film, and it is preferred that on the side opposite to the side of the metal film where a layer of the ethylene/carbonyl-containing ethylenic monomer copolymer or its blend is present, a heat-resistant protective coating resin layer having a melting or softening point higher than that of the above copolymer be formed.

As the material constituting this heat-resistant protective coating resin layer, there can be mentioned, for example, linear aromatic polyester resins such as polyethylene terephthalate and polybutylene terephthalate, linear super-polyamides such as nylon-6 and nylon-6,6, olefin resins such as crystalline polypropylene and high density polyethylene, polycarbonates, polysulfones, polyvinyl chloride, polyvinylidene chloride, fluorine resins such as polyvinylidene fluoride, polyvinyl fluoride and polytetrafluoroethylene, and cellulose acetate. Such heat-resistant protective coating resin may be oriented by drawing. For example, there can be used a biaxially drawn polyester film and a biaxially drawn nylon film. If such drawn film is used, a coating layer excellent in the mechanical and thermal properties can be formed on the seam portion.

The above-mentioned respective layers may be independently formed in order on the metal-exposed face of a welded can. Alternately, there may be adopted a method in which a laminate tape including the respective layers is first prepared, this laminate film is applied to the metal-exposed face which is heated and fusion bonding is effected, whereby coated welded cans can easily be prepared at a high efficiency.

In accordance with one preferred embodiment of the present invention, there is provided a process for the preparation of coated welded cans, which comprises heating a welded can having a metal-exposed face inclusive of a seam at least on said metal-exposed face, supplying to the metal-exposed face of the welded can a laminate tape comprising (a) a layer comprised of a copolymer of ethylene with a carbonyl group-containing, ethylenically unsaturated monomer or a blend thereof, (b) a layer of a heat-resistant resin having a melting or softening point higher than that of said copolymer or blend and (c) a metal film interposed between said two resin layers, so that the layer of said copolymer or blend confronts the metal-exposed face, and fusion-bonding said laminate to the metal-exposed face to completely cover the metal-exposed face.

In this laminate tape, the layer of the copolymer or blend may be bonded to the metal film through an isocyanate type adhesive or the like or directly by fusion bonding of the copolymer. Furthermore, the metal film may be bonded to the heat-resistant protective resin layer through an isocyanate adhesive or the like or directly by vacuum deposition or plating. When the laminate tape is applied to the outer face of the welded can, a white or colored printing ink layer may be formed on the metal film side of the heat-resistant protective resin layer so as to eliminate the metallic luster. Of course, if the color or hue of this printing ink layer is the same as that of the printing ink layer 8 on the outer face of the can blank, the appearance characteristics of the seam can further be improved.

In this laminate tape, in order to obtain complete adhesion and protection of the seam portion, it is preferred that the layer of the copolymer or its blend should have a thickness of 5 to 150 μm, especially 10 to 80 μm. Furthermore, in order to obtain sufficient corrosion resistance and necessary flexibility, it is preferred that the metal film should have a thickness of 0.05 to 100 μm, especially 0.1 to 40 μm. In order to obtain perfect protection of the metal film, it is preferred that the heat-resistant protective resin layer should have a thickness of 5 to 100 μm.

This laminate film may be formed according to known means such as dry lamination, extrusion coating and sandwich lamination.

The metal-exposed face of the welded can may be heated locally by high frequency induction heating, direct flame heating, hot air blow heating, contact with a heating roller or infrared heating, or it may be heated entirely in a hot air furnace or the like. High frequency heating is especially preferred because heating of the metal-exposed face can be accomplished at a high speed and a high efficiency.

For applying the laminate tape to the metal-exposed face, there may be adopted a method in which a welded can is continuously travelled, and a laminate tape is unwound from a reel of the laminate tape and supplied to an applicator roll having contact with the metal-exposed face of the welded can. Bonding of the laminate tape is advantageously carried out at a temperature higher than the melting or softening point of the ethylene/carbonyl-containing ethylenic monomer copolymer or its blend but lower than the melting or softening point of the heat-resistant protective resin layer, whereby complete adhesion of the laminate tape and complete covering with the laminate tape can be accomplished without reduction of the appearance of the seam or degradation of the corrosion resistance. Of course, this heat bonding can be performed in one stage or in two stages of preliminary bonding and main bonding.

In order to obtain further complete bonding of the laminate tape, the ethylene/carbonyl-containing ethylenic monomer copolymer layer may be subjected to the corona discharge treatment. This corona discharge treatment is a known film surface-treating technique, and this treatment may be conducted according to known procedures.

A known corona discharge electrode such as a knife edge electrode, a wire electrode or a rotary insulating electrode may be used as the discharge electrode. The treatment is ordinarily carried out while maintaining a gap of 0.5 to 2.0 mm between the film to be treated and the end of the electrode.

As the generator to be used for the corona discharge treatment, there may be mentioned a generator of the spark gap type, a generator of the vacuum tube type or a generator of the high frequency impulse type. Ordinarily, the applied voltage for the corona discharge is 5 to 25 KV and the output is arranged in the range of 1 to 500 W·min/m$^2$, especially 3 to 100 W·min/m$^2$. If the corona discharge treatment is carried out under these conditions, the objects of the present invention can advantageously be attained.

The coating according to the present invention is especially effective for covering the seam on the outer face of the welded can. However, even if the seam on the inner face of the welded can is covered according to the present invention, the intended effects can similarly be attained. Thus, in each case, the above-mentioned excellent advantages can be attained.

The present invention will now be described in detail with reference to the following Examples.

In these Examples, all of "%" and "parts" are by weight unless otherwise indicated.

In each of the following Examples and Comparative Examples, the tests were carried out according to the following procedures.

1. Manufacture of Cans:

TFS can bodies were manufactured according to the following procedures.

The face of a tin-free steel plate (steel plate electrolytically treated with chromic acid) having a thickness of 0.23 mm, which was to be formed into an inner face of a can, was coated with an epoxy-phenolic varnish while the portion to be formed into a seam remains uncoated, followed by baking, and the face to be formed into an outer face was coated and printed, whereby a blank having a size of 206.5 mm×104.5 mm was prepared. The coating layers formed by the electrolytic chromic acid treatment on both the surfaces were scraped off on both the short side edges along a width of about 1 mm so that the iron faces were completely exposed. The blank was formed into a cylinder by a roll former so that the short sides were in agreement with the axial direction of the cylinder. The side edges were lapped and fixed in a welding station, and while a compressive force (45 Kg) was applied to the lapped portion, by a roll electrode through a wire electrode, welding was carried out at a welding speed of 30 m/min to obtain a welded can body for a can of nominal number 7 (having a nominal diameter of 211). The lap width after welding was about 0.4 mm.

Tinplate can bodies were manufactured according to the following procedures.

The face of a tinplate formed by the electric tin plating and having a thickness of 0.23 mm and an amount plated of tin of 25 lb/BB (a tin layer thickness of about 0.6 μm), which was to be formed into an inner face of a can, was coated with an epoxy-phenolic varnish while remaining the portion to be formed into a seam uncoated, followed by baking, and the face to be formed into an outer face was coated and printed, whereby a blank having a size of 206.5 mm×104.5 mm was prepared. The blank was formed into a cylinder by a roll former so that the short sides were in agreement with the axial direction. In a welding station, the edges were lapped and fixed and while a compressive force (45 Kg) was applied to the lapped portion of the cylinder, by a roll electrode through a wire electrode, welding was carried out at a welding speed of 30 m/min as in case of TFS can bodies, to obtain a welded can body for a can of nominal number 7 (having a nominal diameter of 211). The lap width after welding was about 0.4 mm.

2. Packing and Sterilization:

The seam portion of the welded can body was treated with a sample, and the welded can body was subjected to flanging processing, a bottom lid was double-seamed to the can body, a content was packed in the can body and a top lid was double-seamed to the packed can body. When the content was consomme soup or coffee, the content heated at 90° C. was packed in the can body, a top lid was double-seamed to the can body and the packed can was sterilized at 120° C. for 120 minutes. Then, the packed can was subjected to the storage test. When the content was other than consomme soup or coffee, the content was packed, a top lid was double-seamed in vacuo and the packed can was sterilized at 120° C. for 120 minutes. Then, the packed can was subjected to the storage test. The can used for the test had a nominal diameter of 211 and an inner capacity of 318.2 ml. Tinplate lids having an inner face coated with an epoxy-phenolic varnish were used for tinplate can bodies, and TFS lids having an inner face coated with an epoxy-phenolic varnish were used for TFS can bodies.

3. Leakage, Formation of Hydrogen and Dissolved Iron:

All the packed cans were stored at 37° C. After passage of 3 weeks from the start of the storage test, the cans were tapped, and in case of cans where tapping sounds were bad, the degree of vacuum was measured by a vacuum gauge. A can where reduction of the degree of vacuum was detected was designated as the leakage can. The leakage ratio was expressed as the ratio of the number of leakage cans to the total number of tested cans (about 100 cans). Amounts of formed hydrogen were determined only with respect to packed cans where the content contained solids. The packed cans were stored at 37° C. for 1 year, and gases were collected when the cans were opened. The amounts of hydrogen in the collected gases were determined by the gas chromatography, and the arithmetic mean value was calculated from the results obtained with respect to 10 cans. Amounts of dissolved iron were determined only with respect to cans where the packed content was liquid. After the cans had been opened, the contents were directly analyzed by the atomic absorption spectroscopy to determine the amounts of iron in the contents. The arithmetic mean value was calculated from the results obtained with respect to 10 cans.

4. Perforation and State of Corrosion:

The packed cans were stored at 37° C. for 1 year, and with respect to the packed cans where leakage of the content (liquid) was detected by the naked eye observation, the sample-applied portion near the seam portion was observed by a microscope after opening and the can where the presence of through holes was observed was designated as the perforated can. Moreover, after opening, the sample-applied portion near the seam portion was observed by a microscope, and the corrosion state was checked. About 100 cans were subjected to the storage test with respect to each sample, and 50 cans optionally selected from these cans were subjected to the corrosion test.

EXAMPLE 1

Samples 1 through 6 and comparative sample 1 were prepared and applied according to the following procedures.

Samples 1 through 5 were formed by bonding a biaxially drawn polyethylene terephthalate film having a thickness of 12 μm to one surface of an aluminum foil having a thickness of 9 μm by an isocyanate type adhesive and extrusion-coating an ethylene/vinyl acetate copolymer having a vinyl acetate content of 0.5, 5, 10, 20 and 30%, respectively on the other surface of the aluminum foil by using an isocyanate type anchoring agent. In each sample, the thickness of the ethylene/vinyl acetate copolymer layer was about 80 μm. Sample 6 was formed by subjecting two tinplate sheets and an ethylene/vinyl acetate copolymer having a vinyl acetate content of 41%, which was interposed between the two tinplate sheets, to hot press molding, amalgamating the tin layers of the tinplate sheets with mercury to obtain a sheet of the above copolymer having a thickness of about 80 μm and fusion-bonding this copolymer sheet to the aluminum face of an aluminum foil/biaxially drawn polyethylene terephthalate film laminate such as described above by using a heating roll. Comparative sample 1 was formed by extrusion-coating low density polyethylene in a thickness of about 80 μm on the aluminum face of an aluminum foil/biaxially drawn polyethylene terephthalate film laminate such as described above by using an isocyanate type anchoring agent.

These 7 laminate sheets were subjected to the corona discharge treatment at an output of 50 W·min/m$^2$ by a corona discharge surface treatment apparatus having a rotary insulating electrode so that the ethylene/vinyl acetate copolymer surface or low density polyethylene surface was treated.

Each laminate sheet was cut into a tape having a width of 8 mm, and the tape was fusion-bonded to the seam portion on the inner face side of the welded can heated at about 250° C. according to the high frequency induction heating method while pressing this tape to the seam portion by a rubber roll. If this fusion bonding method was adopted, the metal face or the edge of the laminate sheet was covered and protected with the molten resin. At this fusion bonding step, the laminate sheet was set so that the ethylene/vinyl acetate copolymer face or the low density polyethylene in case of comparative sample 1 was fusion-bonded to the seam portion.

A content shown in Table 1 was packed in the resulting sample can body and the packed can was subjected to the storage test. The obtained results are shown in Table 1.

nate sheet is peeled from the can body and the metal-exposed portion is completely rusted.

EXAMPLE 2

Samples 7 through 9 were prepared and applied according to the following procedures.

Sample 7 was formed by bonding a biaxially drawn polyethylene terephthalate film having a thickness of 12 μm to an aluminum foil having a thickness of 9 μm by using an isocyanate type adhesive and extrusion-coating an ethylene/fumaric acid copolymer (having a fumaric acid content of 10%) in a thickness of about 50 μm on the aluminum surface of the laminate by using an isocyanate type anchoring agent. Sample 8 was formed by extrusion-coating an ethylene/maleic anhydride copolymer (having a maleic anhydride content of 10%) in a thickness of about 50 μm on the aluminum surface of a laminate such as mentioned by using an isocyanate type anchoring agent. Sample 9 was formed by extrusion-coating an ethylene/methyl methacrylate copolymer (having a methyl methacrylate content of 10%) in a thickness of about 50 μm on the aluminum surface of a laminate such as mentioned above by using an isocyanate type anchoring agent.

The extrusion coating layer of each of the so formed laminate sheets was subjected to the corona discharge treatment in the same manner as described in Example 1 and was bonded to a welded can in the same manner as

TABLE 1

| | | | | Results of Storage Test | | | | | | | |
|---|---|---|---|---|---|---|---|---|---|---|---|
| | | | | Oil-Preserved Tuna | | | | Coffee | | | |
| | | | | tinplate cans | | TFS cans | | tinplate cans | | TFS cans | |
| Sample No. | Vinyl Acetate Content (%) | Leakage Ratio (%) | Ratio (%) of perforated can(%) | amount(ml) of formed hydrogen | corrosion state | amount(ml) of formed hydrogen | corrosion state | amount (ppm) of dissolved iron | corrosion state | amount (ppm) of dissolved iron | corrosion state |
| 1 | 0.5 | 0 | 0 | 0.02 | not changed | 0.01 | not changed | 0.04 | not changed | 0.03 | not changed |
| 2 | 5 | 0 | 0 | 0.02 | not changed | 0.01 | not changed | 0.01 | not changed | 0.02 | not changed |
| 3 | 10 | 0 | 0 | 0.03 | not changed | 0.02 | not changed | 0.01 | not changed | 0.01 | not changed |
| 4 | 20 | 0 | 0 | 0.02 | not changed | 0.01 | not changed | 0.02 | not changed | 0.01 | not changed |
| 5 | 30 | 0 | 0 | 0.03 | not changed | 0.02 | not changed | 0.03 | not changed | 0.03 | not changed |
| 6 | 41 | 0 | 0 | 0.01 | not changed | 0.01 | not changed | 0.01 | not changed | 0.01 | not changed |
| Comparative Sample 1 | 0 | 0 | 11.0 | 8.62 | many spots of iron sulfide | 10.5 | iron sulfide on entire surface | 29.2 | many rust spots | 18.5 | rusting on entire surface |

From the results shown in Table 1, it is seen that in case of cans prepared by using samples 1 through 6, complete adhesion of the laminate sheet to the can is maintained and no corrosion is caused, but in case of cans prepared by using comparative sample 1, the lamidescribed in Example 1 to form a test can. The test can was packed with consomme soup or oil-preserved tuna and subjected to the storage test. The obtained results are shown in Table 2.

TABLE 2

| | | | | Results of Storage Test | | | | | | | |
|---|---|---|---|---|---|---|---|---|---|---|---|
| | | | | Oil-Preserved Tuna | | | | Sonsomme Soup | | | |
| | | | | | | TFS can | | tinplate can | | TFS can | |
| Sample No. | Carbonyl Group-Containing, Ethylenically Unsaturated Monomer | Leakage Ratio (%) | Ratio(%) of Perforated Cans | tinplate can amount(ml) of formed hydrogen | tinplate can corrosion state | amount (ml) of formed hydrogen | corrosion state | amount (ppm) of dissolved iron | corrosion state | amount (ppm) of dissolved iron | corrosion state |
| 7 | fumaric acid | 0 | 0 | 0.11 | not changed | 0.21 | not changed | 0.20 | not changed | 0.19 | slight corrosion on alumi- |

TABLE 2-continued

| Sample No. | Carbonyl Group-Containing, Ethylenically Unsaturated Monomer | Leakage Ratio (%) | Ratio(%) of Perforated Cans | Results of Storage Test: Oil-Preserved Tuna, tinplate can: amount(ml) of formed hydrogen | Oil-Preserved Tuna, tinplate can: corrosion state | Oil-Preserved Tuna, TFS can: amount (ml) of formed hydrogen | Oil-Preserved Tuna, TFS can: corrosion state | Sonsomme Soup, tinplate can: amount (ppm) of dissolved iron | Sonsomme Soup, tinplate can: corrosion state | Sonsomme Soup, TFS can: amount (ppm) of dissolved iron | Sonsomme Soup, TFS can: corrosion state |
|---|---|---|---|---|---|---|---|---|---|---|---|
| 8 | maleic anhydride | 0 | 0 | 0.16 | not changed | 0.15 | not changed | 0.25 | not changed | 0.21 | num slight corrosion on aluminum |
| 9 | methyl-methacrylate | 0 | 0 | 0.12 | not changed | 0.10 | not changed | 0.18 | not changed | 0.20 | not changed |

EXAMPLE 3

Samples 10 and 11 and comparative sample 2 were prepared by extrusion-coating a blend comprising an ethylene/vinyl acetate copolymer having a vinyl acetate content of 10% and an additive component shown in Table 3 in an amount shown in Table 3 in a thickness of about 50 μm by using an isocyanate type anchoring agent on the aluminum surface of a laminate formed by bonding a biaxially drawn polyethylene terephthalate film having a thickness of 12 μm to an aluminum foil having a thickness of 9 μm by using an isocyanate type adhesive.

Each of the so obtained laminate sheets was subjected to the corona discharge treatment in the same manner as described in Example 1, and was then bonded to a can in the same manner as described in Example 1. Coffee was packed in the bonded can and the packed can was subjected to the storage test. The obtained results were shown in Table 3.

No change was observed at all in the cans prepared by using samples 10 and 11. In contrast, in the can prepared by using comparative sample 2, cracks were formed in the blend layer in the portion near the lid-double-seamed portion and corrosion was expanded from this portion as the center. Furthermore, in the can prepared by using comparative sample 2, the amount of dissolved iron was much larger than in the cans prepared by using samples 10 and 11. Thus, it was confirmed that the can prepared by using comparative sample 2 could not be put into practical use.

TABLE 3

| Sample No. | Additive | Amount (%) of Additive | Leakage Ratio (%) | Ratio (%) of Perforated Cans | Results of Storage Test Coffee, tinplate can: amount (ppm) of dissolved iron | tinplate can: corrosion state | TFS can: amount (ppm) of dissolved iron | TFS can: corrosion state |
|---|---|---|---|---|---|---|---|---|
| 10 | polymerized rosin | 10 | 0 | 0 | 0.03 | not changed | 0.05 | not changed |
| 11 | rosin modified with phenolic resin | 10 | 0 | 0 | 0.03 | not changed | 0.02 | not changed |
| Comparative Sample 2 | rosin modified with phenolic resin | 50 | 0 | 1.0 | 23.5 | violent rusting in the vicinity of double-seamed portion | 30.9 | violent rusting in the vicinity of double-seamed portion |

EXAMPLE 4

Samples 12 and 13 were prepared by extrusion-coating a blend comprising an ethylene/vinyl acetate copolymer having a vinyl acetate content of 10% and oleic acid amide in an amount of 0.07% and 0.2%, respectively in a thickness of about 30 μm by using an isocyanate type anchoring agent on the aluminum surface of a laminate formed by bonding a biaxially drawn polyethylene terephthalate film having a thickness of 12 μm to an aluminum foil having a thickness of 9 μm by using an isocyanate type adhesive. Sample 14 was prepared by extrusion-coating a blend comprising an ethylene/vinyl acetate copolymer such as mentioned above and 0.2% of a silicone oil in a thickness of about 30 μm by using an isocyanate type anchoring agent on the aluminum surface of a laminate such as mentioned above. Sample 15 was prepared by extrusion-coating a blend comprising an ethylene/vinyl acetate copolymer such as mentioned above and 5% of low-molecular-weight polypropylene in a thickness of about 30 μm by using an isocyanate type anchoring agent on the aluminum surface of a laminate such as mentioned above.

The extrusion-coated resin surface of each laminate sheet was subjected to the corona discharge treatment, and the laminate sheet was cut into a tape having a width of 8 mm. The tape was bonded to the seam portion on the inner face side of the can in the same manner as described in Example 1.

The so prepared cans were packed with consomme soup and boiled tuna, and the packed cans were stored under the predetermined conditions described hereinbefore. In any of the cans prepared by using the foregoing samples, leakage, formation of hydrogen, perforation, dissolution of iron or corrosion was not observed at all.

EXAMPLE 5

Samples 16 and 17 were prepared by bonding a biaxially drawn polyethylene terephthalate film having a thickness of 12 μm to one surface of an aluminum foil having a thickness of 50 μm or 20 μm by using an isocyanate type adhesive and fusion-bonding an ethylene/vinyl acetate copolymer (having a vinyl acetate content of 10%) film having a thickness of 50 μm to the other surface of the aluminum foil by a heating roll. Samples 18 through 20 were prepared by forming a vacuum deposition film of aluminum, chromium and nickel, respectively having a thickness of 0.2 μm on one surface of a biaxially drawn polyethylene terephthalate film having a thickness of 12 μm by the high frequency ion plating method and fusion-bonding a film of the above-mentioned ethylene/vinyl acetate copolymer having a thickness of 50μ to the vacuum deposition metal film by using a heating roll. Comparative sample 3 was prepared by fusion-bonding an ethylene/vinyl acetate copolymer film mentioned above to a biaxially drawn polyethylene terephthalate film having a thickness of 12 μm. Incidentally, the surface of the ethylene/vinyl acetate copolymer film to be fusion-bonded to the metal surface was subjected to the corona discharge treatment in advance.

The ethylene/vinyl acetate copolymer surface of each of the so obtained laminate sheets was subjected to the corona discharge treatment in the same manner as described in Example 1 and the sheet was cut into a tape having a width of 8 mm. The tape was pressed by a rubber roll to the seam portion on the outer face side of a welded can heated at 250° C. by the high frequency induction heating method to fusion-bond the tape to the seam portion. The test cans were subjected to flanging processing, and lids were double-seamed to both the ends of each can without packing any content. With respect to each sample, 150 of double-seamed empty TFS cans and 150 of double-seamed empty tinplate cans were prepared, and 50 each of the TFS cans and tinplate cans were sterilized at 120° C. for 120 minutes and then subjected to the storage test. Another 50 each of the TFS cans and tinplate cans were dipped in an aqueous solution containing 400 ppm of sodium nitrite at 75° C. for 2 minutes and then subjected to the storage test, and remaining 50 each of the TFS cans and tinplate cans were directly subjected to the storage test. The storage test was conducted in an atmosphere maintained at a temperature of 37° C. and a relative humidity of 90% for 1 year. After 1 year's storage, the appearances of these test cans were checked by the naked eye observation. In the cans prepared by using samples 16 through 20, any change was observed at all, as compared with the appearances before the storage test. However, in the cans prepared by using comparative sample 3, rusting was observed in the iron-exposed portion in the vicinity of the seam portion and the appearance characteristics were degraded.

What we claim is:

1. A coated welded can comprising a metal can body having a longitudinal seam formed by lapping both edges of a can blank and welding the lapped edges and a coating covering a metal-exposed face inclusive of the seam, wherein said coating comprises a laminate comprising (a) a layer comprised of a copolymer of ethylene with a carbonyl group-containing, ethylenically unsaturated monomer or a blend containing said copolymer, (b) a layer of a heat-resistant resin having a melting point or softening point higher than that of said copolymer or blend and (c) a metal film interposed between said two layers, said layer of the copolymer or blend of the laminate tape being subjected to corona discharge treatment prior to the application to the metal-exposed face, and said laminate being applied to the metal-exposed face in such relation that the layer (a) of said copolymer or the blend thereof is located on the metal-exposed face and adheres to said metal-exposed face by fusion of the layer (a).

2. A coated welded can as set forth in claim 1, wherein said copolymer contains 0.5 to 40% by weight of the carbonyl group-containing, ethylenically unsaturated monomer.

3. A coated welded can as set forth in claim 1, wherein said copolymer is an ethylene/vinyl acetate copolymer.

4. A coated welded can as set forth in claim 1, wherein layer (a) is said blend which is a composition comprising 70 to 98% by weight of a copolymer of ethylene with a carbonyl group-containing, ethylenically unsaturated monomer and 2 to 30% by weight of a tackifier.

5. A coated welded can as set forth in claim 4, wherein the tackifier is a modified or unmodified rosin, a terpene polymer or a vinyl aromatic polymer.

6. A coated welded can as set forth in claim 1, wherein said copolymer or blend contains a lubricant in an amount of 0.05 to 5% by weight based on the copolymer.

7. A coated welded can as set forth in claim 1, wherein the heat-resistant resin layer is a biaxially drawn polyester film.

8. A coated welded can as set forth in claim 1, wherein the metal film is an aluminum foil.

9. A coated welded can as set forth in claim 1, wherein the welded can has a can blank exclusive of said metal-exposed face of a small area including the longitudinal seam, and said copolymer or blend is fusion-bonded to the metal-exposed face and the edge portion of the coated or printed face.

10. A process for the preparation of coated welded cans, which comprises heating a welded can having a metal-exposed face inclusive of a seam at least on said metal-exposed face, applying to the metal exposed face of the welded can a laminate tape comprising (a) a layer comprised of a copolymer of ethylene with a carbonyl group-containing, ethylenically unsaturated monomer or a blend thereof, (b) a layer of a heat-resistant resin having a melting or softening point higher than that of said copolymer or blend and (c) a metal film interposed between said two resin layers, so that the layer of said copolymer or blend confronts the metal-exposed face to completely cover the metal-exposed face, further including the step of subjecting said layer of the copolymer or blend of the laminate tape to corona discharge prior to said applying step.

11. A process for the preparation of welded cans according to claim 10, wherein the metal-exposed face of the welded can is heated by high frequency induction heating.

12. The process for the preparation of welded cans according to claim 11 wherein the corona discharge treatment is carried out at an applied voltage of from 5 to 25 KV and at an output in the range from 1 to 500 $W \cdot min/m^2$.

13. A process for the preparation of welded cans according to claim 12 wherein the output of the corona discharge is in the range of from 3 to 100 $W \cdot min/m^2$.

14. A process for the preparation of welded cans according to claim 12 wherein the metal-exposed face of the welded can is heated by high frequency induction heating.

15. A coated welded can according to claim 14 wherein the heat-resistant resin layer (b) is a biaxially drawn nylon film.

16. A coated welded can as set forth in claim 14 wherein the heat-resistant resin of the layer (b) is a resin selected from the group consisting of crystalline polypropylene, high density polyethylene, polycarbonate, polysulfone, polyvinylchloride, polyvinylidenechloride, polyvinylidenefluoride, polyvinylfluoride and polytetrafluoroethylene.

* * * * *

UNITED STATES PATENT AND TRADEMARK OFFICE

CERTIFICATE OF CORRECTION

PATENT NO. : 4,477,501

DATED : October 16, 1984

INVENTOR(S) : KOJIMA, ET AL.

It is certified that error appears in the above-identified patent and that said Letters Patent is hereby corrected as shown below:

Claim 12, line 2, delete "claim 11", insert --claim 10--.
Claim 15, line 1, delete "claim 14", insert --claim 1--.
Claim 16, line 1, delete "claim 14", insert --claim 1--.

Signed and Sealed this

*Twenty-first* Day of *May 1985*

[SEAL]

*Attest:*

DONALD J. QUIGG

*Attesting Officer* *Acting Commissioner of Patents and Trademarks*